US006564511B2

(12) United States Patent
Toth

(10) Patent No.: US 6,564,511 B2
(45) Date of Patent: May 20, 2003

(54) DOOR LOCKING MECHANISM AND METHOD THEREFOR

(75) Inventor: Thomas Toth, Tempe, AZ (US)

(73) Assignee: Frederick L. Toth, Scottsdale, AZ (US)

( * ) Notice: Subject to any disclaimer, the term of this patent is extended or adjusted under 35 U.S.C. 154(b) by 0 days.

(21) Appl. No.: 09/943,301

(22) Filed: Aug. 31, 2001

(65) Prior Publication Data

US 2003/0041521 A1 Mar. 6, 2003

(51) Int. Cl.[7] ..... E05B 65/06

(52) U.S. Cl. ..... 49/394; 16/308; 16/324; 16/326; 16/334

(58) Field of Search ..... 49/381, 394, 397, 49/395; 16/308, 324, 326, 334

(56) References Cited

U.S. PATENT DOCUMENTS 3,578,369 A * 5/1971 Coopersmith ..... 292/58
4,064,652 A 12/1977 Johnston
4,339,844 A 7/1982 Shatters
4,552,392 A 11/1985 Morello
4,609,216 A 9/1986 Baker et al.
4,854,233 A 8/1989 Despot et al.
4,916,926 A 4/1990 Shieh
4,979,265 A * 12/1990 Grass ..... 16/291
5,001,810 A * 3/1991 Baer ..... 16/302
5,104,161 A * 4/1992 Kautt ..... 292/157
5,606,773 A * 3/1997 Shappell ..... 16/298
5,655,798 A 8/1997 Kaveney et al.
6,148,563 A * 11/2000 Roche et al. ..... 49/501

* cited by examiner

*Primary Examiner*—Jerry Redman
(74) *Attorney, Agent, or Firm*—Jeffrey D. Moy; Harry M. Weiss; Weiss, Moy & Harris, P.C.

(57) ABSTRACT

A device for locking a trailer door in a plurality of different opened positions has a plurality of hinges for coupling the door to a frame of the trailer. A torsion bar is coupled to each of the plurality of hinges and to the frame. A rachet mechanism is coupled to the torsion bar which allows the torsion bar to rotate in one direction and in incremental movements thereby allowing one to open and lock the door in a plurality of different positions.

12 Claims, 2 Drawing Sheets

DOOR LOCKING MECHANISM AND METHOD THEREFOR

BACKGROUND OF THE INVENTION

1. Field of the Invention

This invention relates generally to door locks, and more specifically, to a door locking mechanism that will keep the cargo door of a trailer locked in a plurality of partially open positions as well as a fully open position and when released, will allow the cargo door to easily close.

2. Background of the Invention

Trailers will generally have two rear doors for loading and unloading contents into and out of the trailer. The trailer may further have one or more side doors for the same reason as stated above. Many times when loading or unloading the trailer, the door will close on the person loading/unloading the truck. The door will close due to the wind blowing the door close, the truck being parked at an angle causing the doors to shut, or for other similar reasons. The door closing may cause severe injury to the person. The injuries may include broken bones, concussions, and lacerations.

Trailer owners may also want to keep the doors partially open for other reasons. For example, when the trailer is not in use, the owner may want to keep the doors partially open for ventilation so that a must odor does not build up inside the trailer.

Presently, there are devices for keeping the doors of the trailer open. Most of the devices require one to physically latch the door to the side of the trailer in a fully open position. While these latches do work, many people do not use them since they are inconvenient to use. Many individuals don't want to spend the extra time to latch the door to the side of the trailer.

Therefore, a need existed to provide a door locking mechanism for trailer doors. The door locking mechanism will allow one to lock the trailer doors opened in a plurality of partially open positions, as well as a fully open position. The door locking mechanism will prevent injuries whereby the doors of the trailer inadvertently close on individuals hitting them in the head and/or body. The door locking mechanism will further allow one to easily close the cargo door by unlocking the door locking mechanism.

SUMMARY OF THE INVENTION

In accordance with one embodiment of the present invention, it is an object of the present invention to provide a door locking mechanism for trailer doors.

It is another object of the present invention to provide a door locking mechanism which will allow one to lock the trailer doors open in a plurality of partially open positions, as well as a fully open position.

It is still another object of the present invention to provide a door locking mechanism that will allow one to lock the trailer doors open in a plurality of partially open positions, as well as a fully open position but will also allow one to easily close the trailer doors with the door locking mechanism is released.

It is still another object of the present invention to provide a door locking mechanism that will prevent injuries whereby the doors of the trailer inadvertently close on individuals hitting them in the head and/or body.

BRIEF DESCRIPTION OF THE PREFERRED EMBODIMENTS

In accordance with one embodiment of the present invention, a device for locking a trailer door in a plurality of different opened positions is disclosed. The device has a plurality of hinges for coupling the door to a frame of the trailer. A torsion bar is coupled to each of the plurality of hinges and to the frame. A rachet mechanism is coupled to the torsion bar which allows the torsion bar to rotate in one direction and in incremental movements thereby allowing one to open and lock the door in a plurality of different positions.

In accordance with another embodiment of the present invention, a method of providing a device for locking a trailer door in a plurality of different opened positions is disclosed. The method comprises the steps of: providing a plurality of hinges for coupling the door to a frame of the trailer; providing a torsion bar coupled to each of the plurality of hinges and to the frame; and providing a rachet mechanism coupled to the torsion bar which allows the torsion bar to rotate in one direction and in incremental movements thereby allowing one to open and lock the door in a plurality of different positions.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiment when read in conjunction with the accompanying drawings, wherein like reference numerals and symbols represent like elements.

DETAILED DESCRIPTION

Figure 1:
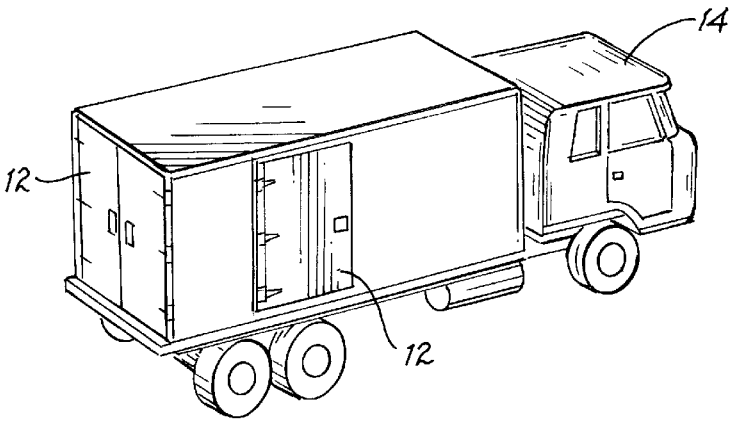
FIG. 1 is an elevated perspective view of a trailer incorporating the door locking mechanism of the present invention.
Figure 2:
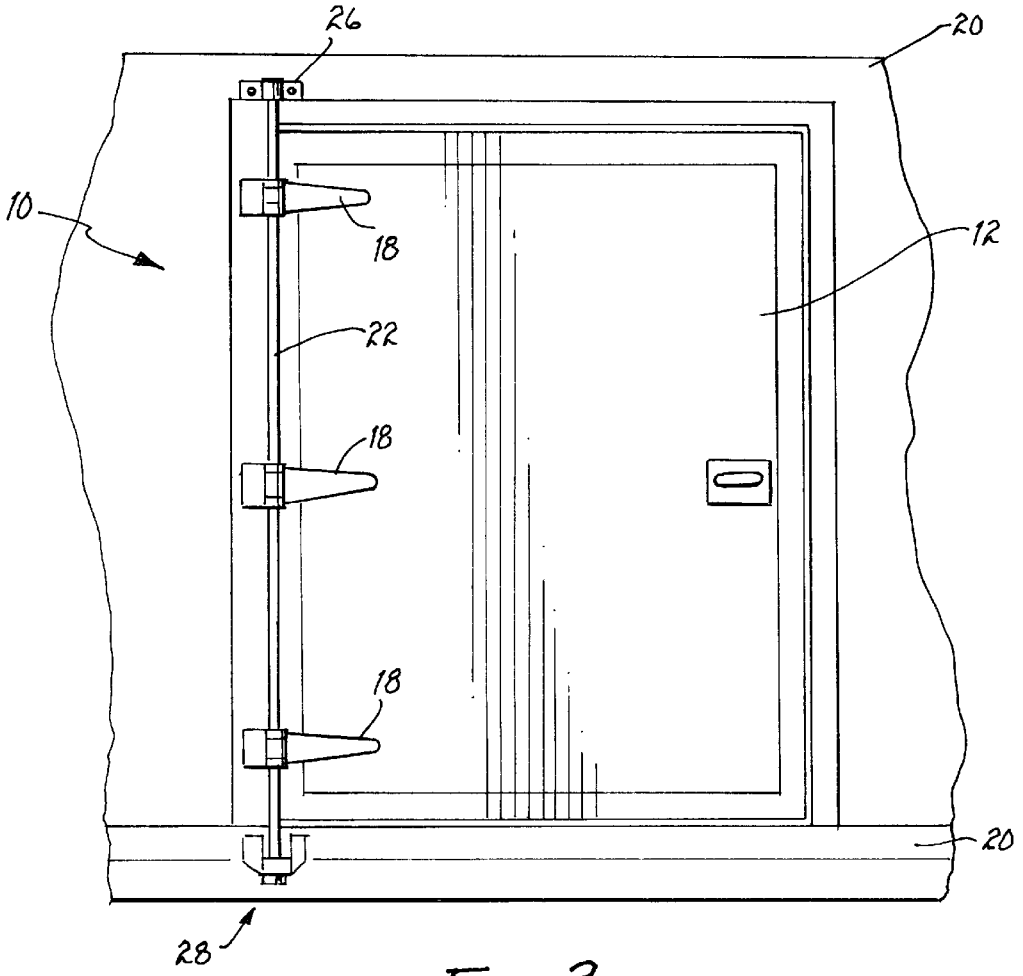
FIG. 2 is a front view of the door locking mechanism of the present invention installed on a trailer door.
Figure 6:
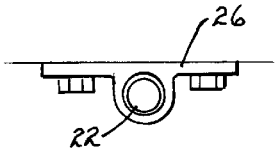
FIG. 6 is a top view of the door locking mechanism of the present invention.
Figure 3:
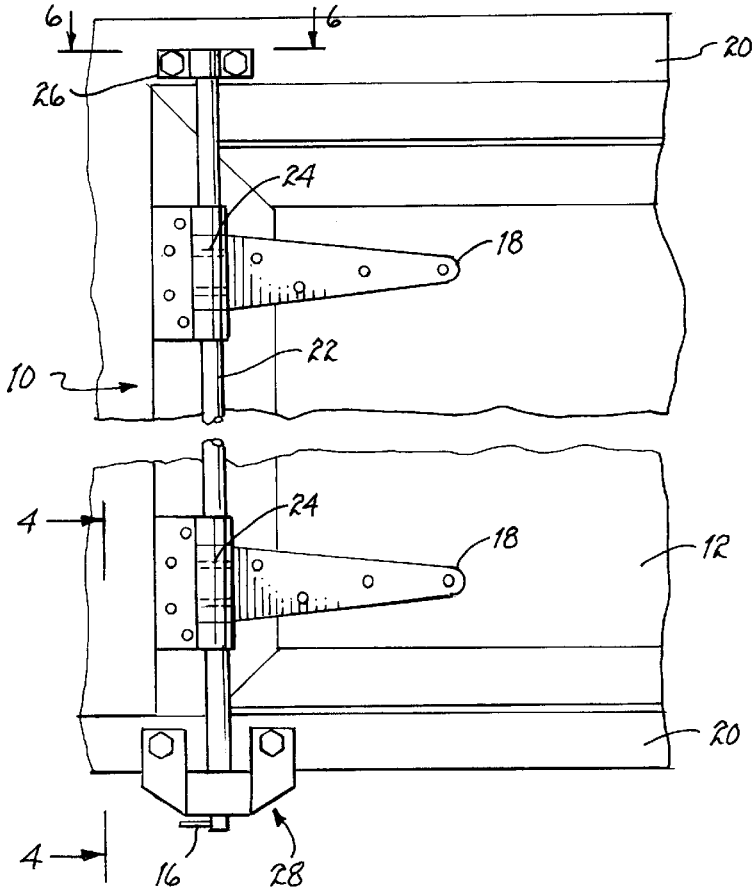
FIG. 3 is a close-up front view of the door locking mechanism of the present invention.
Figure 4:
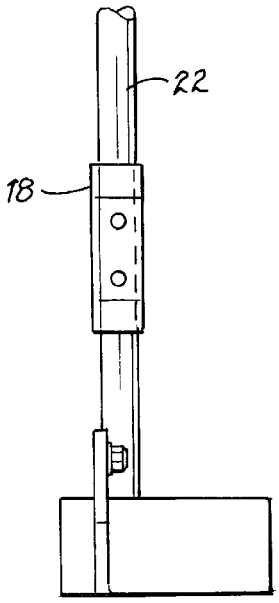
FIG. 4 is a side view of the door locking mechanism of the present invention.
Figure 5:
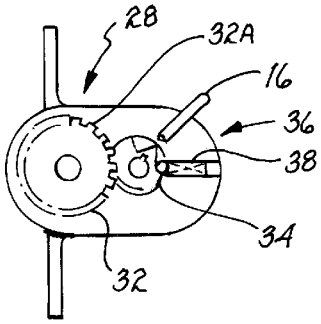
FIG. 5 is a top view of a rachet device used in the door locking mechanism of the present invention.
Figure 7:
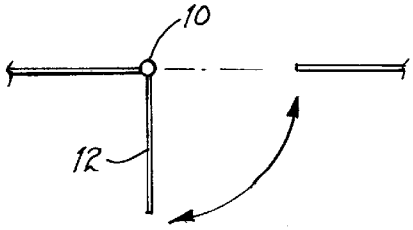
FIG. 7 is a top view of the trailer door showing the movement of the door.

Referring to the Figures wherein like numerals and symbols represent like elements, a door locking mechanism 10 is shown. The door locking mechanism 10 is used to lock the door 12 of a trailer 14 in a plurality of different positions. The door locking mechanism 10 will keep the door 12 in a fully open or partially open position thereby prevent the door 12 from accidentally closing on individuals in and/or near the door 12 of the trailer 14. To close the door 12, one only has to release a lever 16 unlocking the door 12 from it's current position.

The door locking mechanism 10 uses one or more hinges 18. The hinge(s) 18 are coupled both to the door 12 and to the frame 20 of the trailer 14. It should be noted that the hinges 18 could also be coupled to a door sill of the trailer 14 if a door sill of sufficient width is available. The remainder of the patent will use the term frame 20. However, it should be noted that the frame 20 would also include the door sill. The hinge(s) 18 are used to allow the door 12 to rotate open relative to the frame 20 of the trailer 14 where the hinge(s) 18 are coupled thereto. The hinge(s) 18 may be coupled to the door 12 and the frame 20 via a plurality of different means. In general, some type of locking bolt, screw or rivet is used. However, this should not be seen as to limit the scope of the present invention.

A torsion bar 22 is coupled to each hinge 18. The torsion bar 22 is coupled to each hinge 18 by one or more roll pins 24. The roll pins 24 will cause the torsion bar 22 to rotate when the door 12 is moved. When the door 12 is rotated about the hinge(s) 18, the hinge(s) 18 will cause each of the roll pins 24 to rotate. This in turn will cause the torsion bar 22 to rotate.

The torsion bar 22 runs along the height of the door 12. The torsion bar 22 has a first end which is coupled to the frame 20. The torsion bar 22 is generally coupled to the top of the frame 20 by a roller bearing device 26. The roller bearing device 26 will support the torsion bar 22 in place while allowing the torsion bar 22 to rotate.

The torsion bar 22 has a second end which is coupled to a rachet mechanism 28. The rachet mechanism 28 is generally coupled to a bottom section of the frame 20 by a locking bolt/screw. The rachet mechanism 28 will only allow the torsion bar 22, and hence the door 12, to move in one direction and only in incremental movements. Thus, the door 12 may be opened and locked in a plurality of different partially opened positions as well as in a fully opened position. The ratchet mechanism 28 is a reversible ratchet mechanism 28. Thus, by switching a directional lever 16, one may change the direction of the movement of the ratchet mechanism 28.

The ratchet mechanism 28 has a first ratchet gear 32. The first ratchet gear 32 will have a plurality of teeth 32A. Each tooth 32A of the ratchet gear 32 will translate into an incremental movement of the door 12. The ratchet gear 32 will engage a ratchet pawl 34. The ratchet pawl 34 will engage the teeth 32A of the ratchet gear 32 to impart forward motion or prevent backward motion of the ratchet mechanism 28.

A directional selection device 36 is coupled to the ratchet pawl 34. The directional selection device 36 will dictate which direction the ratchet gear 32 and hence the door 12 will rotate. The directional selection device 36 has a spring loaded ball detent 38 which is coupled to the ratchet pawl 34. The spring loaded ball detent 38 will only allow the ratchet mechanism 28 to rotate in a single direction. The directional selection device 36 further has a directional selector lever 16. The lever 16 is coupled to the ratchet pawl 34. The lever 16 works in combination with the ball detent 38 to allow one to select which direction the ratchet mechanism 16 rotates. By rotating the lever 16 over the spring loaded ball detent 38, the ratchet mechanism 28 will rotate in a first direction (i.e., clockwise). Then by rotating the lever 16 back over the spring loaded ball detent 38, the ratchet mechanism 28 will rotate in a second direction (i.e., counterclockwise). It should be noted that the directional selection device 36 may be positioned so that the door 12 will freely close instead of closing in incremental movements.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A device for locking a trailer door in a plurality of different opened positions comprising, in combination:

a plurality of hinges for coupling the door to a frame of the trailer;

a torsion bar coupled to each of the plurality of hinges and to the frame; and a ratchet mechanism coupled to the torsion bar which allows the torsion bar to rotate in one direction and in incremental movements, the ratchet mechanism locking the trailer door in a plurality of different open positions.

2. A device for locking a trailer door in a plurality of different opened positions in accordance with claim 1 further comprising a roller bearing coupled to a top end of the torsion bar and to the frame for supporting the torsion bar and allowing the torsion bar to rotate.

3. A device for locking a trailer door in a plurality of different opened positions in accordance with claim 1 further comprising roll pins coupled to each hinge and to the torsion bar for rotating the torsion bar when the door is moved.

4. A device for locking a trailer door in a plurality of different opened positions in accordance with claim 1 wherein the ratchet mechanism is a reversible ratchet mechanism.

5. A device for locking a trailer door in a plurality of different opened positions in accordance with claim 4 wherein the reversible ratchet mechanism comprises:

a ratchet gear having a plurality of teeth;

a ratchet pawl which engages the ratchet gear to impart forward motion and prevent backward motion of the ratchet mechanism; and a directional selector coupled to the ratchet pawl for selecting a rotation direction for the ratchet mechanism.

6. A device for locking a trailer door in a plurality of different opened positions in accordance with claim 5 wherein the directional selector comprises:

a lever coupled to the ratchet pawl; and a spring loaded ball detent.

7. A device for locking a trailer door in a plurality of different opened positions in accordance with claim 1 wherein the ratchet mechanism comprises:

a ratchet gear having a plurality of teeth;

a ratchet pawl which engages the ratchet gear to impart forward motion and prevent backward motion of the ratchet mechanism; and a lever coupled to the ratchet pawl for unlocking the ratchet mechanism and for allowing the door to freely close.

8. A device for locking a trailer door in a plurality of different opened positions comprising, in combination:

a plurality of hinges for coupling the door to a frame of the trailer;

a torsion bar coupled to each of the plurality of hinges and to the frame;

a ratchet mechanism coupled to the torsion bar which allows the torsion bar to rotate in one direction and in incremental movements, the ratchet mechanism locking the trailer door in a plurality of different open positions;

a roller bearing coupled to a top end of the torsion bar and to the frame for supporting the torsion bar and allowing the torsion bar to rotate; and roll pins coupled to each hinge and to the torsion bar for rotating the torsion bar when the door is moved.

9. A device for locking a trailer door in a plurality of different opened positions in accordance with claim 8 wherein the ratchet mechanism is a reversible ratchet mechanism.

10. A device for locking a trailer door in a plurality of different opened positions in accordance with claim 9 wherein the reversible ratchet mechanism comprises:

a ratchet gear having a plurality of teeth;

a ratchet pawl which engages the ratchet gear to impart forward motion and prevent backward motion of the ratchet mechanism; and a directional selector coupled to the ratchet pawl for selecting a rotation direction for the ratchet mechanism.

11. A device for locking a trailer door in a plurality of different opened positions in accordance with claim 10 wherein the directional selector comprises:

a lever coupled to the ratchet pawl; and a spring loaded ball detent.

12. A device for locking a trailer door in a plurality of different opened positions in accordance with claim 8 wherein the ratchet mechanism comprises:

a ratchet gear having a plurality of teeth;

a ratchet pawl which engages the ratchet gear to impart forward motion and prevent backward motion of the ratchet mechanism; and a lever coupled to the ratchet pawl for unlocking the ratchet mechanism and for allowing the door to freely close.

* * * * *